United States Patent [19]

Seguin et al.

[11] 4,012,029

[45] Mar. 15, 1977

[54] TUNDISHES

[75] Inventors: Claude Seguin, Orgeval; Bernard de Wiet, Valence, both of France

[73] Assignee: Foseco Trading A.G., Chur, Switzerland

[22] Filed: July 30, 1974 (Under Rule 47)

[21] Appl. No.: 493,893

[30] Foreign Application Priority Data

July 30, 1973 United Kingdom ..... 36185/73

[52] U.S. Cl. ..... 266/275; 266/281; 222/460

[51] Int. Cl.[2] ..... C21B 3/00

[58] Field of Search ..... 266/280, 281, 282, 275; 222/591, 478, 460, 461

[56] References Cited

UNITED STATES PATENTS

| | | | |
|---|---|---|---|
| 1,681,943 | 8/1928 | Marshall | 266/280 |
| 1,871,159 | 8/1932 | Davis et al. | 266/287 X |
| 1,917,849 | 7/1933 | Northrup | 266/281 X |
| 3,203,689 | 8/1965 | Hallowen, Jr. et al. | 266/281 X |
| 3,458,641 | 7/1969 | Perucchetti | 266/281 X |

FOREIGN PATENTS OR APPLICATIONS

| | | | |
|---|---|---|---|
| 2,259,553 | 6/1973 | Germany | |
| 2,010,743 | 11/1971 | Germany | 266/281 |

*Primary Examiner*—Roy Lake
*Assistant Examiner*—Paul A. Bell
*Attorney, Agent, or Firm*—Cushman, Darby & Cushman

[57] ABSTRACT

A tundish comprising an outer metal casing, a permanent lining of refractory material adjacent the casing, a layer of essentially unbonded particulate refractory material adjacent the permanent lining and, adjacent the layer of particulate refractory material, an expendable lining made up of a set of slabs of refractory heat-insulating material.

12 Claims, 3 Drawing Figures

TUNDISHES

This invention relates to tundishes and particularly to tundishes for use in continuous casting.

A tundish has been described comprising an outer metal casing, a permanent lining of refractory material adjacent the casing and an expendable lining made up of a set of slabs of refractory material of low thermal conductivity, the impact area of the tundish being lined with highly erosion resistant or sacrificial material. Any large gaps between the permanent and expendable linings may be filled, e.g. by loose facing sand.

It has now been found that additional improvements may be obtained if the tundish is lined with a three layer system consisting of a permanent refractory lining of refractory material, a layer of essentially unbonded particulate refractory material and an expendable lining made up of a set of slabs of refractory heat-insulating material.

Thus, according to the present invention there is provided a tundish comprising an outer metal casing, a permanent lining of refractory material adjacent the casing, a layer of essentially unbonded particulate refractory material adjacent the permanent lining, and adjacent the layer of particulate refractory material an expendable lining made up of a set of slabs of refractory heat-insulating material. The impact area of the tundish may be lined with highly erosion resistant or sacrificial material, as described in our copending application referred to above.

Preferably the refractory heat insulating material is of low thermal conductivity and low thermal capacity.

The construction of tundishes in this way gives great flexibility in the detailed arrangement of the various components; for example, the thickness and type of each layer may be varied dependent on the exact position in the tundish. Thus, it is now possible to vary the heat flow from the molten metal in the tundish to give optimum results.

Accordingly in a preferred tundish of the invention the lining system is such that when the tundish is filled with molten metal the rate of heat loss from the molten metal is greater in the area where the molten metal is fed into the tundish than in the area or areas from which the molten metal is withdrawn.

This difference may be effected in practice in several different ways: if a permanent refractory lining is present, this may be thinner or of more heat conductive material in the inflow area of the tundish than in the nozzle areas. Alternatively, the essentially unbonded particulate refractory material may be in a thinner layer, or of a different type (e.g. sand near the nozzles; graphite, coke, steel balls near the inlet area). Alternatively the slabs of refractory heat insulating material may be of different thickness and/or thermal conductivity as between the two areas.

The permanent refractory lining may be made of refractory bricks or it may be a cast monolithic lining. When the permanent lining is refractory brick it is desirable that the joints between the bricks are sealed to prevent penetration of the unbonded particulate material. If silica sand is used as the unbonded particulate material and penetration occurs in the joints, expansion of the silica on heating may cause damage to the permanent lining. The composition of the brick or that of the lining material may vary to promote the different heat flows noted above.

The layer of essentially unbonded particulate refractory material may be made up of a wide variety of such materials known in the art. Preferably, cheap materials are used for economy, since no substantially improved results are obtained by using expensive particulate refractory materials. Silica sand, olivine sand, chromite sand, crushed chamotte, and grog, crushed fire clay and crushed basic refractories such as magnesite are all widely available and give satisfactory service in the present invention. Of these materials, silica is the least preferred because of the high degree of expansion which occurs as a result of $\alpha$- quartz transforming to $\beta$-quartz when silica is heated to 500° – 600° C.

The expendable lining may be made up of slabs of refractory heat-insulating material, for example of refractory fibers (e.g. asbestos, calcium silicate fiber, aluminium silicate fiber), refractory filler (e.g. silica, alumina, magnesia, refractory silicates) and binder (e.g. colloidal silica sol, sodium silicate, starch, phenol-formaldehyde resin, urea-formaldehyde resin). In order to increase the thermal conductivity of lining slabs in the area of metal flow into the tundish, ingredients such as silicon carbide may be introduced as part of the filler in the composition of the slabs. The slabs forming the expendable lining are preferably of low thermal conductivity and of low thermal capacity to minimise chilling when the tundish is first filled with molten metal.

The construction of tundishes according to the present invention is straightforward. The permanent lining is first installed in the metal casing. Thereafter the expendable lining of slabs is located in position and the gap behind the expendable lining then filled with the unbonded refractory, e.g. by hand or with suitable apparatus such as a core-blower which may introduce the particulate refractory suspended in a stream of compressed air.

It is desirable to provide means for separating the permanent lining from the expendable lining in order to facilitate the introduction of the layer of particulate refractory material. The desired means for separation may be provided in a variety of ways, viz:-

1. If the permanent lining is of refractory brick, protuberances may be produced at certain areas on the surface of the lining during the brick-laying operation.
2. If the permanent lining is a cast or rammed monolithic structure similar protuberances may be produced during ramming or casting.
3. Separators in the form of pieces of refractory heat-insulating material, e.g. refractory brick may be placed between the permanent lining and the expendable lining during the construction of the expendable lining, or between the expendable lining and the metal casing.
4. Protuberances may be produced on the surface of the rear face of some of the slabs from which the expendable lining is constructed.

It is desirable to minimise the area of contact between the separators and the linings or casing so the cross-sectional area of the ends of the separators or of the ends of the protuberances on the permanent or expendable lining should be as small as possible, and the total number of separators or protuberances should be the minimum necessary to maintain the required separation between the permanent and expendable linings. It is to be remembered that the separators only have to be effective during construction of the tundish and before the introduction of the particulate refractory material. Afterwards, stresses in use are taken up by the layer of particulate refractory material.

The thickness of the three layers will usually be as follows:

permanent lining: 1 cm to 10 cm, preferably 2 cm to 6 cm, layer of particulate refractory material: 1 cm to 5 cm, preferably 2 cm to 4 cm, expendable lining: 0.5 cm to 10 cm, preferably 1.2 cm to 5 cm.

The use of a layer of particulate refractory material between the permanent and expendable linings offers a number of advantages:

1. If molten metal penetrates through the expendable lining solidification takes place in the layer of particulate material thus preventing adherence and hence damage to the permanent lining or the casing.

2. At the end of the casting cycle metal skull and burnt-out expendable lining are more readily removed from the tundish. The particulate refractory material prevents the permanent and expendable linings from bonding together and stripping of the expendable lining can be effected simply by inverting the tundish to allow the particulate refractory material to fall out. Alternatively, and this is a particularly valuable feature of the present invention, loops of steel strip may be built in running around the tundish cavity in the gap which is otherwise filled with unbonded refractory material. At the end of a casting cycle, these loops may be engaged by a crane around the whole of the skull and expendable lining may be removed quickly and easily.

3. The particulate refractory material contributes to the insulating efficiency of the overall lining system and allows the thickness of the permanent lining, if used, to be much reduced.

It is advantageous to construct the expendable lining slabs so they protrude a little above the top of a rim around the edge of the usually horizontal upper flange of the metal casing. This enables the channel between the expendable lining slabs and the rim to be filled with the loose unbonded refractory, and this shallow layer of refractory so formed acts to protect the upper flange of the metal casing from damage, e.g. by splashes of molten metal.

The invention is illustrated, by way of example, in the accompanying drawings in which.

Figure 1:
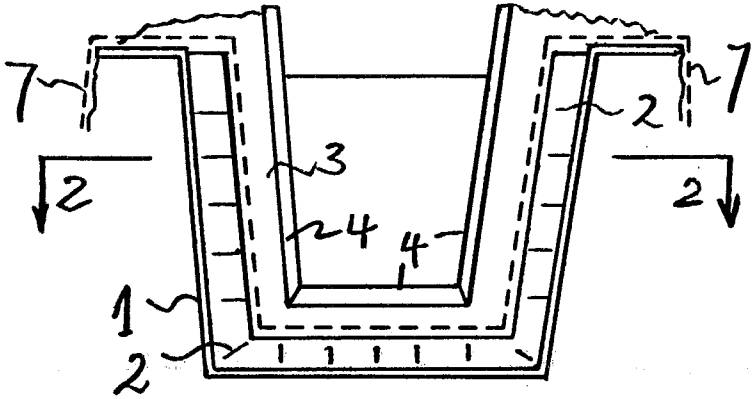
FIG. 1 is a transverse section through a tundish according to the invention in the plane 1 — 1 indicated on FIG. 2.
Figure 2:
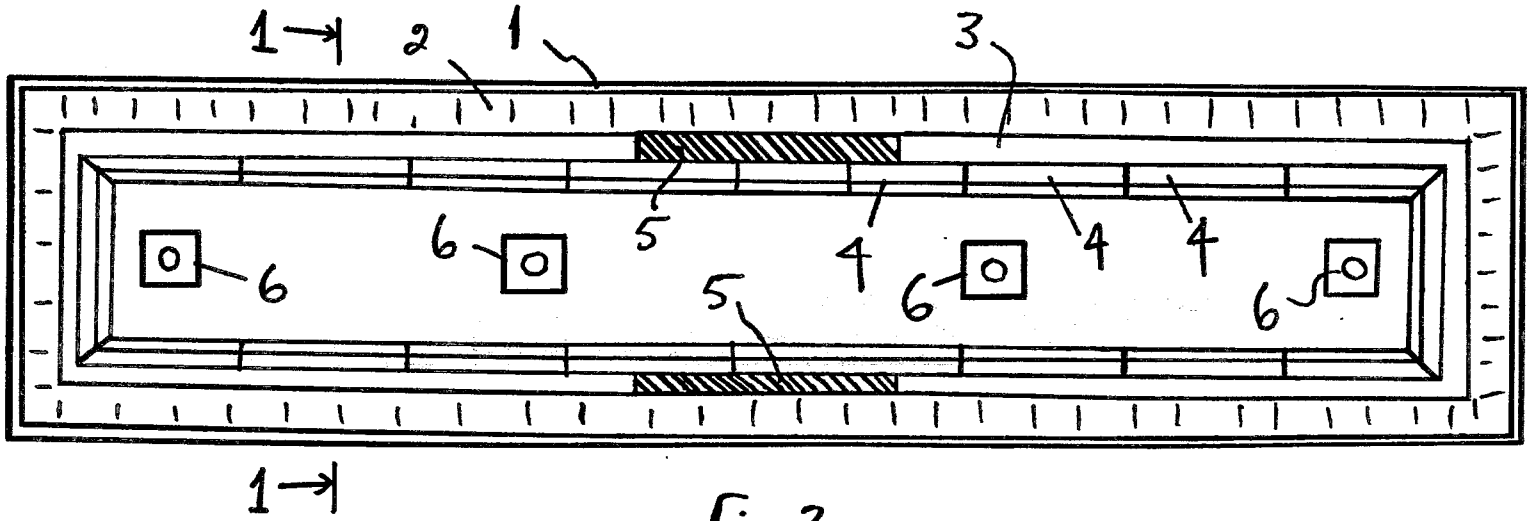
FIG. 2 is a cut-away part sectional view along the plane 2 — 2 of FIG. 1.

Referring to FIGS. 1 and 2, the tundish consists of an outer metal casing 1. This is first lined with a permanent refractory brick lining 2. Next is a layer of unbonded sand 3 and finally an inner lining of slabs 4. Near the impact area of the tundish, between slabs 4 and lining 2, are slabs of heat conductive material 5, e.g. made of a bonded calcium silicate/graphite mixture. Four nozzles 6 are set in the base of the tundish. Located at various points along the length of the tundish are lengths of chain 7 (not shown in FIG. 2). After casting has finished, the free ends of chain 7 are joined and metal skull in the tundish may be lifted out, together with the expendable lining of slabs 4.

Figure 3:
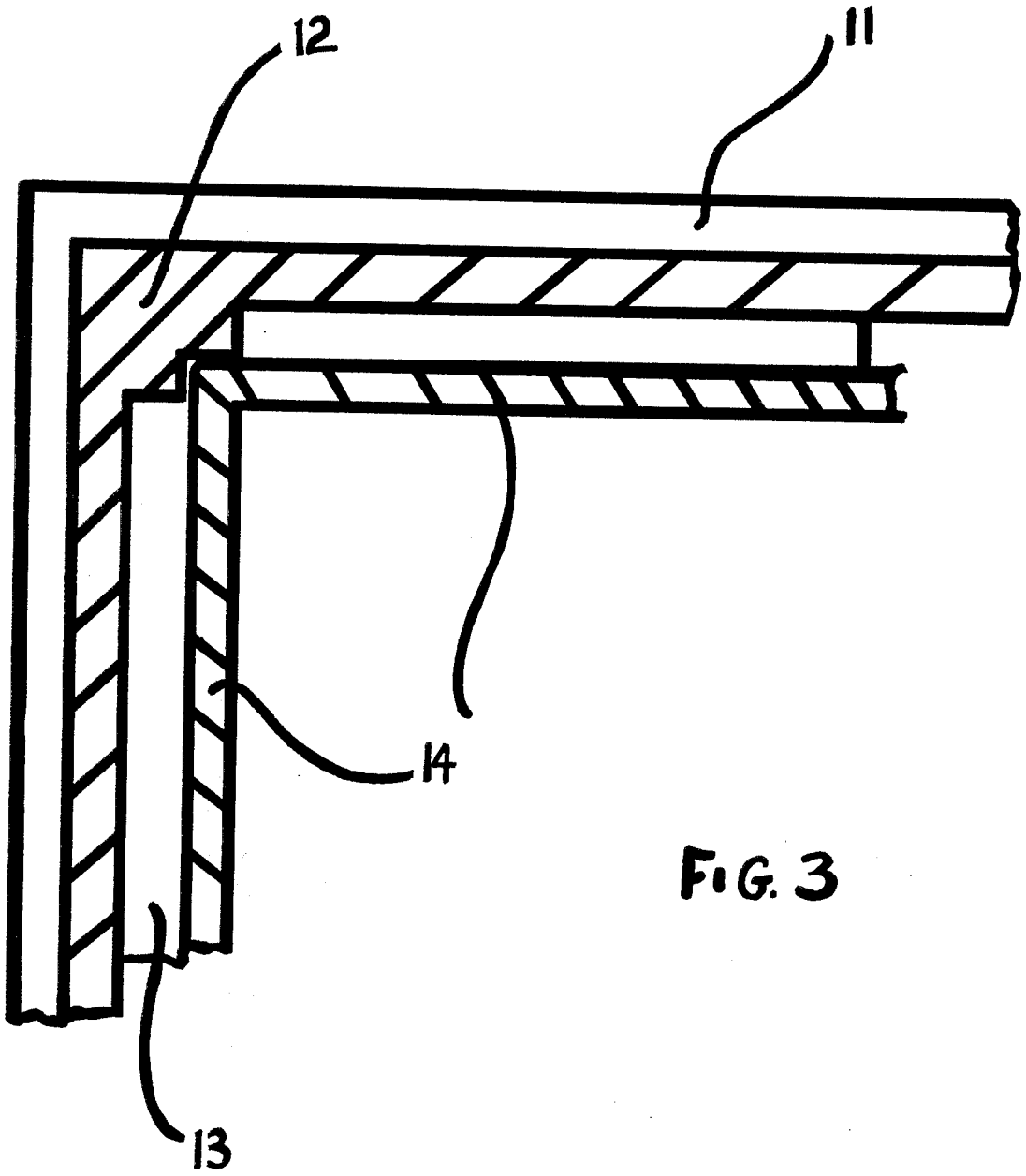
FIG. 3 is a view from above of one corner of an alternative tundish according to the invention.

Referring to FIG. 3, an outer metal casing 11 has a permanent monolithic refractory lining 12 having two protuberances at the corner of the tundish. A layer of unbonded sand is denoted 13 and an inner lining 14 is provided formed of slabs of refractory heat insulating material.

The following examples will serve to illustrate the invention:

EXAMPLE 1

A steel tundish was lined with 114 mm thick refractory bricks using refractory cement as jointing compound to produce a cavity measuring 6 meters in length, 600 mm in width at the top, 400 mm in width at the bottom and 800 mm in depth.

The base of the tundish was then covered with a layer of loose silica sand to a depth of 10 mm. A high alumina refractory plate was placed on the layer of sand at the point above which molten metal enters the tundish, and the remainder of the sand was covered with boards of refractory heat insulating material containing asbestos fiber and dead burnt magnesite as filler. The plate and boards were joined together using a refractory mortar. The walls of the tundish were lined with magnesite/asbestos boards in a similar way so as to leave a varying gap of approximately 10 mm between the boards and the permanent brick lining. The gap was then completely filled with loose silica sand.

The tundish was used in the continuous casting of low carbon, aluminium killed deep drawing steel, the temperature of the steel in the tundish being 1535° C. Three 180 tonne heats were cast in sequence.

After casting the tundish was allowed to cool inverted, and the metal skull remaining in the tundish fell out together with the expendable lining and silica sand.

No damage to the permanent brick lining resulted, and the tundish was used for further continuous casting operations after relining as described.

EXAMPLE 2

A steel tundish was lined with a high alumina castable refractory material using a wooden former to produce a shape having protuberances at the corners as shown in FIG. 3, and a cavity measuring 1095 mm in length, 352 mm in width at the base, and 450 mm in depth.

The base of the tundish was covered with a layer of olivine sand to a depth of approximately 10 mm and then lined with an alumina plate and refractory heat insulating boards as described in Example 1.

Each wall of the tundish was lined with a single refractory heat insulating board using the protuberances in the corners to locate the boards, and create a gap of about 15 mm between the boards and the monolithic lining. The joints between the boards were filled with a refractory jointing compound. The gap was then completely filled with olivine sand.

The tundish was used to cast 40 tonnes of low alloy steel for the production of seamless tube containing 1.3% manganese, 0.32% silica and 0.25% carbon. The temperature of the steel in the tundish was 1590° C.

After casting the tundish was allowed to cool, and then inverted to remove the metal skull remaining, the expendable lining and the olivine sand.

We claim:

1. In a tundish comprising an outer metal casing and a permanent lining of refractory material adjacent the casing, the improvement which comprises providing a layer of essentially unbonded particulate refractory material adjacent and parallel the permanent lining and, adjacent the layer of particulate refractory material and in parallel spaced relation to the permanent lining, an expendable lining made up of a set of slabs of refractory heat-insulating material.

2. The tundish of claim 1 wherein the permanent lining has protuberances serving to space the slabs of the expendable lining from the permanent lining.

3. The tundish of claim 1 wherein the slabs of the expendable lining bear projections which abut the permanent lining.

4. The tundish of claim 1 and including separators between the permanent lining and the slabs of the expendable lining.

5. The tundish of claim 1 wherein the permanent lining is formed of refractory brick.

6. The tundish of claim 1 wherein the permanent lining is a cast monolithic lining.

7. The tundish of claim 1 wherein the permanent lining is 1 – 10 cm thick.

8. The tundish of claim 1 wherein the unbonded particulate refractory material is selected from the class consisting of silica sand, olivine sand, chromite sand, crushed chamotte, grog, crushed fireclay and crushed basic refractories.

9. The tundish of claim 1 wherein the thickness of the essentially unbonded layer is 1 – 5 cm.

10. The tundish of claim 1 wherein the slabs of refractory heat-insulating material are formed of refractory fiber, refractory filler and a binder.

11. The tundish of claim 1 wherein the slabs of the expendable lining are 0.5 to 10 cm thick.

12. The tundish of claim 1 wherein the metal casing has an upper horizontal outwardly directed flange, the slabs of the expendable lining extend to above the level of the flange, and the flange is covered by a layer of essentially unbonded particulate refractory material.

* * * * *